US009631294B2

(12) United States Patent
Weinhold et al.

(10) Patent No.: US 9,631,294 B2
(45) **Date of Patent: *Apr. 25, 2017**

(54) DEVICE FOR VERTICAL GALVANIC METAL DEPOSITION ON A SUBSTRATE

(71) Applicant: Atotech Deutschland GmbH, Berlin (DE)

(72) Inventors: Ray Weinhold, Nürnberg (DE); Ferdinand Wiener, Burgthann (DE)

(73) Assignee: Atotech Deutschland GmbH, Berlin (DE)

( * ) Notice: Subject to any disclaimer, the term of this patent is extended or adjusted under 35 U.S.C. 154(b) by 23 days.

This patent is subject to a terminal disclaimer.

(21) Appl. No.: 14/653,462

(22) PCT Filed: Dec. 3, 2013

(86) PCT No.: PCT/EP2013/075425

§ 371 (c)(1),
(2) Date: Jun. 18, 2015

(87) PCT Pub. No.: WO2014/095356

PCT Pub. Date: Jun. 26, 2014

(65) Prior Publication Data

US 2016/0194776 A1 Jul. 7, 2016

(30) Foreign Application Priority Data

Dec. 20, 2012 (EP) ..... 12075142

(51) Int. Cl.
*C25D 5/08* (2006.01)
*C25D 17/00* (2006.01)
(Continued)

(52) U.S. Cl.
CPC ..... *C25D 5/08* (2013.01); *C25D 3/38* (2013.01); *C25D 7/00* (2013.01); *C25D 7/12* (2013.01);
(Continued)

(58) Field of Classification Search
CPC ..... C25D 5/026
See application file for complete search history.

(56) References Cited

U.S. PATENT DOCUMENTS 4,119,516 A * 10/1978 Yamaguchi ..... C25D 5/08 204/206
4,534,832 A * 8/1985 Doiron, Jr. ..... C25D 5/022 204/273

(Continued)

FOREIGN PATENT DOCUMENTS

| | | |
|---|---|---|
| CN | 101730760 | 6/2010 |
| DE | 102007026633 | 12/2008 |
| WO | 2010108996 | 9/2010 |

OTHER PUBLICATIONS

PCT/EP2013/075425; PCT International Search Report and Written Opinion of the International Searching Authority dated Jan. 21, 2014.

(Continued)

*Primary Examiner* — Harry D Wilkins, III
(74) *Attorney, Agent, or Firm* — Renner, Otto, Boisselle & Sklar, LLP

(57) ABSTRACT

A method and device for vertical galvanic metal deposition on a substrate, the device including at least first and second device elements arranged vertically parallel to each other, the first device element including at least a first anode element having a plurality of through-going conduits and at least a first carrier element having a plurality of through-going conduits, the at least first anode element and the at least first carrier element firmly connected to each other; and (Continued)

the second device element including at least a first substrate holder adapted to receive at least one substrate to be treated, the at least one substrate holder at least partially surrounding the at least one substrate along its outer frame after receiving it; the distance between the first anode element and the at least first substrate holder ranging from 2 to 15 mm.

21 Claims, 9 Drawing Sheets

(51) Int. Cl.

| | |
|---|---|
| ***C25D 17/12*** | (2006.01) |
| ***C25D 7/12*** | (2006.01) |
| ***C25D 17/06*** | (2006.01) |
| ***C25D 3/38*** | (2006.01) |
| ***C25D 7/00*** | (2006.01) |

(52) U.S. Cl.
CPC ..... *C25D 17/001* (2013.01); *C25D 17/06* (2013.01); *C25D 17/12* (2013.01)

(56) References Cited

U.S. PATENT DOCUMENTS

| | | | | | |
|---|---|---|---|---|---|
| 4,853,099 | A * | 8/1989 | Smith | C25D 5/026 | 204/224 R |
| 4,931,150 | A * | 6/1990 | Smith | C25D 5/026 | 205/118 |
| 5,002,649 | A * | 3/1991 | Smith | C25D 5/026 | 156/345.18 |
| 5,421,987 | A * | 6/1995 | Tzanavaras | C25D 5/08 | 204/212 |
| 5,516,412 | A | 5/1996 | Andricacos et al. | | |
| 5,595,640 | A * | 1/1997 | von Hoffmann | C25D 5/08 | 204/206 |
| 5,837,399 | A * | 11/1998 | Oswald | H01M 2/30 | 429/101 |
| 5,976,329 | A * | 11/1999 | Bock | C25D 1/10 | 204/212 |
| 2002/0020627 | A1 * | 2/2002 | Kunisawa | C25D 17/12 | 205/96 |
| 2005/0056538 | A1 | 3/2005 | Kovarsky et al. | | |
| 2005/0205429 | A1 | 9/2005 | Gebhart et al. | | |
| 2009/0139870 | A1 | 6/2009 | Nagai et al. | | |
| 2010/0176004 | A1 | 7/2010 | Schneider et al. | | |
| 2012/0000785 | A1 | 1/2012 | Zahraoui et al. | | |
| 2012/0305404 | A1 | 12/2012 | Keigler | | |

OTHER PUBLICATIONS

PCT/EP2013/075425; PCT International Preliminary Report on Patentability mailed Mar. 23, 2015.

Search Report for corresponding Chinese Application No. 201380062928.6 dated Feb. 16, 2016.

* cited by examiner

DEVICE FOR VERTICAL GALVANIC METAL DEPOSITION ON A SUBSTRATE

The present application is a U.S. National Stage Application based on and claiming benefit and priority under 35 U.S.C. §371 of International Application No. PCT/EP2013/075425, filed 03 Dec. 2013, which in turn claims benefit of and priority to European Application No. 12075142.5 filed 20 Dec. 2012, the entirety of both of which is hereby incorporated herein by reference.

FIELD OF THE INVENTION

The present invention is generally directed to a device for vertical galvanic metal, preferably copper, deposition on a substrate. The invention further relates to a method for vertical galvanic metal, preferably copper, deposition on a substrate using such a device.

BACKGROUND OF THE INVENTION

Production of semi conductive integrated circuits and other semi conductive devices from semiconductor wafers typically requires formation of multiple metal layers on the wafer to electrically interconnect the various devices of the integrated circuit. Electroplated metals typically include copper, nickel, gold and lead. In a typical electroplating apparatus, an anode of the apparatus (either consumable or non-consumable) is immersed in the electroplating solution within the reactor vessel of the apparatus for creating the desired electrical potential at the surface of the work piece for effecting metal deposition. Previously employed anodes have typically been generally disk-like in configuration, with electroplating solution directed about the periphery of the anode, and through a perforate diffuser plate positioned generally above, and in spaced relationship to, the anode. The electroplating solution flows through the diffuser plate, and against the associated work piece held in position above the diffuser. Uniformity of metal deposition is promoted by rotatable driving the work piece as metal is deposited on its surface.

Subsequent to electroplating, the typical semiconductor wafer or other work piece is subdivided into a number of individual semiconductor components. In order to achieve the desired formation of circuitry within each component, while achieving the desired uniformity of plating from one component to the next, it is desirable to form each metal layer to a thickness which is as uniform as possible across the surface of the work piece. However, because each work piece is typically joined at the peripheral portion thereof in the circuit of the electroplating apparatus (with the work piece typically functioning as the cathode), variations in current density across the surface of the work piece are inevitable. In the past, efforts to promote uniformity of metal deposition have included flow-controlling devices, such as diffusers and the like, positioned within the electroplating reactor vessel in order to direct and control the flow of electroplating solution against the work piece.

However, there is still a high demand in the market to provide amended devices and methods using such new amended devices for the galvanic metal deposition, in particular for the vertical galvanic metal deposition.

Typically, the known devices and methods suffer from significant drawbacks in form of non-uniform deposition of such galvanic metals. Further, such known devices and methods are commonly strongly limited in their capacities to successfully and effectively execute bridge-building of galvanic metal in interconnecting holes of the substrate to be treated with subsequent filling of them without generating enclosed voids, gases, electrolytic liquids and alike arising known technical disadvantages like short circuit and alike. The same problem encounters with filling of blind holes in substrates like printed circuits boards, wafers or alike.

OBJECTIVE OF THE PRESENT INVENTION

In view of the prior art, it was thus an object of the present invention to provide a device for vertical galvanic metal deposition on a substrate, which shall not exhibit the aforementioned shortcomings of the known prior art devices.

What is needed therefore is a way to deposit a galvanic metal on at least one side of a substrate in a uniform way without having non-uniform portions or thickness gradients over the surface of said at least one side of the substrate.

Additionally, it is a further object of the invention to provide a device which is not solely capable to deposit a galvanic metal on one side of a substrate, but also to fill blind holes in said substrate.

SUMMARY OF THE INVENTION

These objects and also further objects which are not stated explicitly but are immediately derivable or discernible from the connections discussed herein by way of introduction are achieved by a device having all features of claim 1. Appropriate modifications to the inventive device are protected in dependent claims 2 to 13. Further, claim 14 comprises a method for vertical galvanic metal, preferably copper, deposition on a substrate using such a device, whereas an appropriate modification of said inventive method is comprised by dependent claim 15.

The present invention accordingly provides a device for vertical galvanic metal, preferably copper, deposition on a substrate characterized in that the device comprises at least a first device element and a second device element, which are arranged in a vertical manner parallel to each other, wherein the first device element comprises at least a first anode element having a plurality of through-going conduits and at least a first carrier element having a plurality of through-going conduits, wherein said at least first anode element and said at least first carrier element are firmly connected to each other; and wherein the second device element comprises at least a first substrate holder which is adapted to receive at least a first substrate to be treated, wherein said at least first substrate holder is at least partially, preferably completely, surrounding the at least first substrate to be treated along its outer frame after receiving it; and wherein the distance between the first anode element of the at least first device element and the at least first substrate holder of the second device element ranges from 2 to 15 mm.

It is thus possible in an unforeseeable manner to provide a device for vertical galvanic metal deposition on a substrate, which does not exhibit the aforementioned shortcomings of the known prior art devices.

In addition thereto, the device of the present invention offers a way to deposit a galvanic metal on at least one side of a substrate in a uniform way without having non-uniform portions or thickness gradients over the surface of said at least one side of the substrate.

Furthermore, the present invention provides a device which is not solely capable to deposit a galvanic metal on one side of a substrate, but also to fill blind holes in said substrate.

Further, the device of the present invention provides a device wherein the plurality of through-going conduits of the at least first anode element and of the at least first carrier element serve to generate a suitable constant volume flow of the treating solution, in particular of an electrolytic solution known in the prior art, which induces an as high as possible constant volume flow of the treating solution from the center of the surface of the substrate to be treated directed to the outer edges of said substrate to be treated.

BRIEF DESCRIPTION OF THE FIGURES

Objects, features, and advantages of the present invention will also become apparent upon reading the following description in conjunction with the accompanying figures, in which.

DETAILED DESCRIPTION OF THE INVENTION

Figure 1:
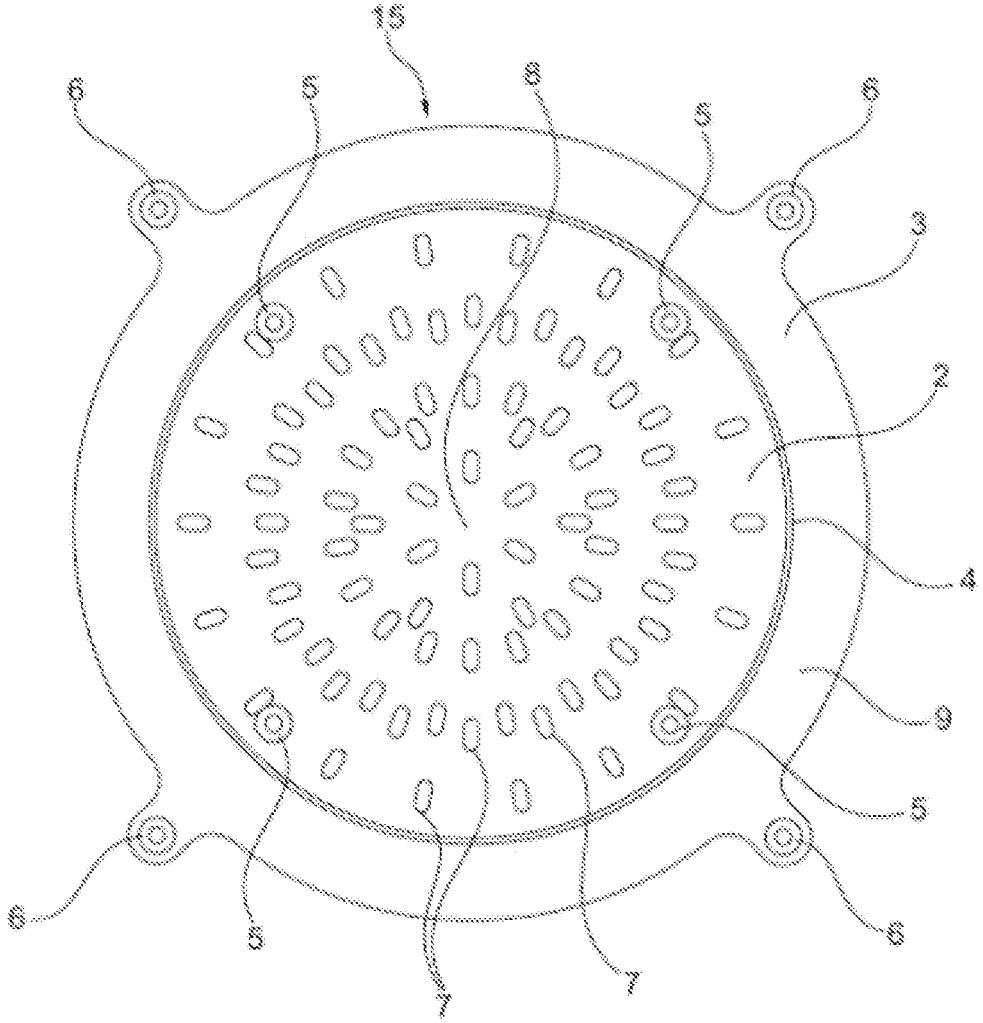
FIG. 1 shows a schematic front view of a first anode element of the first device element of a preferred embodiment of the present invention.

As used herein, the term "galvanic metal", when applied to a device for vertical galvanic metal deposition on a substrate in accordance with the present invention, refers to metals which are known to be suitable for such a vertical deposition method. Such galvanic metals comprise gold, nickel, and copper, preferably copper.

It has to be noted that each through-going conduit of the at least first anode element has to be aligned with at least one respective through-going conduit of the at least first carrier element in order to allow a constant electrolyte volume flow to the substrate to be treated.

As used herein, the term "firmly connected" refers to a connection of the at least first carrier element and the at least first anode element lying in front of said carrier element without having any remarkable distance there between. Such a distance being not negligible would lead to a disadvantageous broadening of the electrolyte flow after having passed the through-going conduits of the carrier elements before reaching the respective through-going conduits of the first anode element.

It has been found advantageous, if such a distance between the firmly connected first carrier element and the first anode element is smaller than 50 mm, preferably smaller than 25 mm, and more preferably smaller than 10 mm.

It can be found suitable in the sense of the present invention that the at least first anode element of the first device element and/or of the third device element is at least partially, preferably completely, surrounded by the at least first carrier element of the first device element and/or of the third device element, wherein the side of said at least first carrier element directed towards said at least first anode element has a cavity to take said at least first anode element in such a way that the upper edges of the at least first carrier element and of the at least first anode element are aligned or not, preferably aligned.

Such a device offers a highly compact arrangement of the first device element based on the preferred alignment of the upper edges of the first carrier element and the first anode element. Thus, the first anode element is not a separated piece of the device spaced apart from the first carrier element as known in prior art, but it represents a uniform device unit leading to a smaller device saving cost, wherein the first anode element supports as well the stability of the whole first device element.

As used herein, the distance between the first anode element and the opposite laying substrate holder is measured as the length of the perpendicular going from the surface of said first anode element to the opposite laying surface of said substrate holder.

In one embodiment, the at least first anode element is an insoluble anode comprising a material coated with titanium or an iridium oxide.

In one embodiment, the at least first substrate to be treated is round, preferably circular, or angular, preferably polyangular, such as rectangular, quadratic or triangular, or a mixture of round and angular structure elements, such as semicircular; and/or wherein the at least first substrate to be treated has a diameter ranging from 50 mm to 1000 mm, preferably from 100 mm to 700 mm, and more preferably from 120 mm to 500 mm, in case of a round structure; or a side length ranging from 10 mm to 1000 mm, preferably from 25 mm to 700 mm, and more preferably from 50 mm to 500 mm, in case of an angular, preferably polyangular, structure and/or wherein the at least first substrate to be treated is a printed circuit board, a printed circuit foil, a semiconductor wafer, a wafer, a solar cell, a photoelectric cell, a flat panel display or a monitor cell. The first substrate to be treated can be composed of one material or of a mixture of different materials, such as glass, plastics, molded compounds or ceramics.

It can be further intended by the present invention that the general shape of the at least first anode element and/or of the at least first carrier element of the first and/or third device element is orientated at the general shape of the substrate to be treated and/or of the substrate holder of the second device element. Hereby, the galvanic metal deposition can still be made more efficient and cost saving by reducing the required device construction conditions.

In another embodiment of the present invention, the device further comprises a third device element, which is arranged in a vertical manner parallel to the first device element and the second device element in such a way that the second device element is arranged between said first device element and said third device element, wherein the third device element comprises at least a first anode element having a plurality of through-going conduits and at least a first carrier element having a plurality of through-going conduits, wherein said at least first anode element and said at least first carrier element are firmly connected to each other; and wherein the distance between the first anode element of the at least third device element and the at least first substrate holder of the second device element ranges from 2 to 15 mm.

Additionally, by providing such a third device element, which can be identical or different in comparison to the first device element, it has been surprisingly found that, in contradiction to the known prior art devices, the device of the present invention is not solely suitable to deposit metal, in particular copper, on both sides of the substrates to be treated of the second device element, but also to successfully and effectively execute bridge-building of galvanic metal in interconnecting holes of the substrate to be treated of the second device element with subsequent filling of them without generating enclosed voids, gases, electrolytic liquids and alike.

In a preferred embodiment, the first device element and/or the third device element further comprises a masking element having a plurality of through-going conduits, which is detachably connected to the at least first anode element of the first device element and/or of the third device element, and preferably also to the at least first carrier element of the first device element and/or of the third device element, wherein the distribution of the plurality of through-going conduits on the surface of said masking element is homogenous or inhomogeneous.

Such a masking element, which is installed and arranged in front of the respective first anode element of the first and/or third device element, influences the distribution and the formation of the electric field coming from the first anode element on its way to the substrate to be treated. Thus, in dependence of the kind of substrate to be treated, which is intended to be used, the masking element offers the possibility to influence said electric field in such a way that a most effective desired uniform electric field distribution is generated, which again leads consequently to a most effective uniform galvanic metal deposition on the surface of the substrate to be treated.

It is also possible to generate different desired galvanic metal deposition density areas during the galvanic metal deposition process in order to be able to handle substrates to be treated, which comprise different areas with different densities of blind holes and/or through connecting vias. Thus, the masking element can be individually designed in dependence of the surface and/or of the structural composition or layout of the substrate to be treated.

Such an individual design can be generated by an intended certain distribution of the through-going conduits of the masking element, which possesses so a kind of individual perforated structure. The masking element shall have, to be effective, a size of at least the same dimension as the first anode element to avoid undesired electric field edge effects.

The present invention provides a device that ensures a constant volume flow speed of the treating solution wherein the volume flow speed is ranging from 0.1 to 30 m/s, preferable from 0.5 to 20 m/s, and more preferably from 1 to 10 m/s.

The total volume of the treating solution, which is flowing from the surface of the center of the substrate to be treated to the outer edges of the substrate to be treated, is constantly increasing due to the fact that additional volume flow is reaching the substrate surface through the through-going conduits of the at least first carrier element and the at least first anode element of the first and/or third device element and combines with the volume flow already passing the substrate surface on its way from the center to the outer edges of the substrate.

The overall thickness of the at least first carrier element of the first and/or third device element is ranging from 4 mm to 25 mm, preferably from 6 mm to 18 mm, and more preferably from 8 mm to 12 mm; whereas the overall thickness of the at least first anode element of the first and/or third device element is ranging from 1 mm to 20 mm, preferably from 2 mm to 10 mm, and more preferably from 3 mm to 5 mm.

The alignment of the upper edges of the at least first carrier element and of the at least first anode element, both of the first and/or third device element, supports the above-cited limitation of the overall thickness of the at least first anode element of the first and/or third device element due to the fact that the side of the at least first carrier element and of the at least first anode element, both of the first and/or third device element, opposite to the respective side of the substrate to be treated of the second device element shall possess a uniform flat surface without any obstacles in form of height differences between the at least first carrier element and of the at least first anode element, both of the first and/or third device element.

In a preferred embodiment of the present invention, the through-going conduits of the at least first anode element of the first and/or third device element can be coated with a conductive additive.

In a preferred embodiment of the present invention, the through-going conduits of the at least first anode element and/or of the at least first carrier element of the first and/or third device element can possess the same or different average diameters ranging from 0.2 mm to 10 mm, preferably from 1 mm to 8 mm, and more preferably from 2 mm to 5 mm.

In a preferred embodiment of the present invention, the through-going conduits of the at least first anode element and/or of the at least first carrier element of the first and/or third device element can possess the same or different lengths. In a preferred embodiment of the present invention, the distance between the first device element and the at least first substrate holder of the second device element ranges from 2 to 15 mm, preferably from 3 to 11 mm, and more preferably from 4 to 7 mm.

The claimed device for vertical galvanic metal deposition on a substrate comprises a higher distance between the first anode element of the first and/or third device element and the surface of the substrate to be treated of the second device element than the distance between the first anode element of the first and/or third device element and the substrate holder of the second device element. Conclusively, there is a, in particular conical, diminution at the outer edges of the distance between the first anode element of the first and/or third device element and the second device element leading to an increase of the volume flow speed directed to the outer edges. Thereby, the difference of the static pressure caused by the height difference by the vertical arranged device becomes commonly negligible in comparison to the dynamic part of the pressure of the volume flow of the treating solution.

In an alternative embodiment of the present invention, the distance between the first device element and the at least first substrate holder of the second device element could be arranged in such a way that the distance is not continuously constant. This could be used to generate an intentional gradient of metal, in particular copper, deposition thickness over the substrate to be treated.

In a further embodiment, the device further comprises means to generate a relative movement between the second device element on one side and the first device element and/or the third device element on the other side in directions parallel to the treated side of the substrate to be treated.

Such an oscillating movement is advantageous due to a generation of a more uniform distribution of the overall galvanic metal, in particular copper, deposition thickness on the surface of the substrate to be treated of the second device element. Without such an oscillating movement, it could be in a worst case scenario, that there is a non-uniform thickness of the metal, in particular copper, on the surface caused by a higher metal, in particular copper, deposition at sites of the surface of the substrate to be treated of the second device element where the volume flow of the treating solution reaches via through-going conduits directly the surface compared to a lower metal, in particular copper, deposition at sites of the surface of the substrate to be treated of the second device element where the volume flow of the treating solution does not reach via through-going conduits directly the surface of the substrate to be treated of the second device element. By applying such an oscillating movement the above-mentioned disadvantageous effect can be overcome.

In one embodiment, the first anode element of the first device element and/or of the third device element comprise at least two segments, wherein each anode element segment can be electrically controlled and/or regulated separately from each other; and/or wherein an anode segment, preferably the most exterior anode segment, and/or an exterior area inside of an anode segment, preferably inside of the most exterior anode segment, and/or an area around the center of the first anode element is comprised without through-going conduits. Herein, there can be a non-conductive layer and/or an intermediate spacing between these anode segments.

In particular, the control and/or the regulation of the current can be advantageous in order to reduce the metal, in particular the copper, deposition at desired sites of the surface of the substrate to be treated, such as in the most exterior segment and/or the most exterior area inside of an anode segment of the at least first anode element of the first and/or third device element.

The most exterior anode segment and/or anode area inside of the most exterior anode segment of the at least first anode element of the first and/or third device element can comprise a surface area percentage of the overall anode element surface area of at least 5%, preferably of at least 10%, and more preferably of at least 15%.

The most interior anode segment and/or anode area inside of the most interior anode segment of the at least first anode element of the first and/or third device element can comprise a surface area percentage of the overall anode element surface area of at least 30%, preferably of at least 50%, and more preferably of at least 70%.

In one embodiment, the plurality of through-going conduits of the first anode element of the first device element and/or of the third device element are going through the first anode element in form of straight lines having an angle relating to the perpendicular on the first anode element surface between 0° and 80°, preferably between 10° and 60°, and more preferably between 25° and 50°, or 0°. The through-going conduits of the first anode element can generally comprise a round, preferably an elliptical, cross section, and/or the cross section of an oblong hole, preferably wherein the oblong holes have an orientation from the center to the outside of the first anode element.

The at least first anode element of the first or third device element comprise at least one fastening element going through said at least first anode element and the at least first carrier element of the first or third device element. In case that more than one anode element and/or more than one anode segment is provided in the first and/or third device element, it can be intended that at least one fastening element is separately provided for each anode element and/or anode segment of the first and/or third device element. Further, it can be intended in the sense of the present invention that these fastening elements provide simultaneously the electrical contact elements of the at least one anode element and/or one anode segment of the first and/or third device element.

In one embodiment, the plurality of through-going conduits of the first anode element of the first device element and/or of the third device element are arranged on the surface of the first anode element in form of concentric circles around the center of the first anode element; and/or the plurality of through-going conduits of the first carrier element of the first device element and/or of the third device element are arranged on the surface of said first carrier element in form of concentric circles around the center of the first carrier element.

In case of angular, preferably polyangular, such as rectangular, quadratic or triangular, or a mixture of round and angular structure elements, such as semicircular, substrates to be treated of the second device element, it is advantageous to add certain through-going conduits besides the through-going conduits of the above-mentioned concentric circles in the first carrier element and/or the first anode element of the first and/or third device element in order to extend a sufficient and effective incident volume flow as well to the edges and corners of said substrates to be treated of the second device element, wherein in particular these additional through-going conduits are respectively arranged point symmetrical to the center of the first carrier element and/or the first anode element of the first and/or third device element.

In one embodiment, the plurality of through-going conduits of the first carrier element of the first device element and/or of the third device element are going through the first carrier element in form of straight lines having an angle relating to the perpendicular on the carrier element surface between 10° and 60°, preferably between 25° and 50°.

In another embodiment, the through-going conduits inside of a concentric circle around the center of the first carrier element comprise different angles, preferably comprising parts of the concentric circle wherein each second through-going conduit comprise the opposite angle of the respective precedent through-going conduit relating to the perpendicular on the carrier element surface, and more preferably wherein each second through-going conduit of the concentric circle comprise the opposite angle of the respective precedent through-going conduit relating to the perpendicular on the carrier element surface; and/or wherein the through-going conduits inside of a first concentric circle arranged close around the center of the first carrier element comprise smaller angles than the through-going conduits inside of an at least second concentric circle being more exterior than the first concentric circle around the center of the first carrier element, preferably wherein the through-going conduits inside of all more exterior concentric circles of through-going conduits of the first carrier element of the first device element and/or of the third device element comprise larger angles, in particular all the same larger angle. The through-going conduits of the first carrier element can generally comprise a round, preferably a circular, cross section.

In one embodiment, the plurality of through-going conduits of the first carrier element of the first device element and/or of the third device element which are going through the first carrier element in form of straight lines having an angle relating to the perpendicular on the carrier element surface between 10° and 60°, preferably between 25° and 50°; wherein the angles of the through-going conduits of the first carrier element of the first device element being opposite to the through-going conduits of the first carrier element of the third device element are the same or different, preferably the same.

It has been surprisingly found advantageous that the filling of blind holes in the substrate to be treated works the most efficient if the angles of the through-going conduits of the first carrier element of the first device element being opposite to the through-going conduits of the first carrier element of the third device element are the same, whereas the resulting filling becomes worse if said angles are different, wherein the filling is worst at maximum difference of said angles.

In one embodiment, the first carrier element of the first device element and the first carrier element of the third device element, both comprising a plurality of through-going conduits which are going through the first carrier element in form of straight lines having an angle relating to the perpendicular on the carrier element surface between 10° and 60°, preferably between 25° and 50°; are arranged in a vertical manner parallel to each other in such a way that the plurality of through-going conduits of the first carrier element of the first device element are distributed in the same or different way as the plurality of through-going conduits of the first carrier element of the third device element; and/or that the first device element and the third device element are rotated against each other inside of the parallel plane of the vertical arrangement in order to set a specific orientation of the through-going conduits of the first carrier element of the first device element versus the through-going conduits of the first carrier element of the third device element.

It has been surprisingly found especially advantageous, if the through-going conduits of the first carrier element of the first and/or third device element comprise a circular cross section and the through-going conduits of the respective first anode element comprise the cross section of an oblong hole, wherein the oblong holes have an orientation from the center to the outside of the first anode element. Such a geometric arrangement offers the advantage that an volume flow of treating solution can be generated, which leaves the through-going conduit of the first carrier element at the lower side of the first anode element laying in front of it; passes the straight oblong hole (angle of 0°) of the first anode element, and finally flows out of the oblong hole of the first anode element to arrive on the surface of the substrate to be treated. Herein, the volume flow of the treating solution arrives the surface of the substrate to be treated neither parallel nor perpendicular relating to the perpendicular on the carrier element surface.

In a more preferred alternative embodiment, the first carrier element of the first device element and/or of the third device element further comprises a plurality of protrusions on the front surface directed to the at least first anode element, wherein said protrusions fit into the through-going conduits of the first anode element, preferably in such a way that the surfaces of the protrusions of the first carrier element are aligned with the surface of the first anode element; and wherein the through-going conduits of the first carrier element are linearly prolonged through the whole protrusions.

Such protrusions offer the advantage that a fluid flow coming from a source of treating solution can now leave the through-going conduit of the first carrier element at the upper side of the first anode element laying in front of it. Therefore, the first anode element has to comprise through-going conduits in the respective form of the protrusions of the first carrier element in order to allow the protrusions to exactly fit into them.

Thus, the volume flow of the treating solution directly exits the final surface of the first and/or third device element and arrives the surface of the substrate to be treated neither parallel nor perpendicular relating to the perpendicular on the carrier element surface. This is especially advantageous due to the fact that the size and dimension of the through-going conduits of the respective first anode element can be chosen smaller than in case of the absence of such protrusions. Conclusively, the loss of anode surface can be reduced, ideally minimized, by making use of such protrusions.

Another advantage is that there is no decrease of the so-called "recirculation area" of the volume flow of treating solution by the side walls of the through-going conduits of the first anode element. It is generally known in prior art that a volume flow of a solution flows partially back and serves thereby the own volume flow to be prolonged further and stay focused in the prolongation direction. If a hindrance, such as the side walls of the through-going conduits of the first anode element, hampers the recirculation area of the volume flow of the treating solution, the volume flow can become unfocused and widespread leading to an undefined arrival on the surface of the substrate to be treated. This could solely overcome by a large increase of the size and dimensions of the through-going conduits of the first anode elements, which would negatively lead to a large loss of required anode surface, or by applying said protrusions, so that the upper surface of the first anode element is aligned with the upper surface of the protrusions.

Further, the object of the present invention is also solved by a method for vertical galvanic metal, preferably copper, deposition on a substrate using such a device characterized by the following method steps:

i) Providing a device according to one of the preceding claims comprising at least a first device element and a second device element, which are arranged in a vertical manner parallel to each other, wherein the first device element comprises at least a first anode element having a plurality of through-going conduits and at least a first carrier element having a plurality of through-going conduits, wherein said at least first anode element and said at least first carrier element are firmly connected to each other; and wherein the second device element comprises at least a first substrate holder which is adapted to receive at least a first substrate to be treated, wherein said at least first substrate holder is at least partially, preferably completely, surrounding the at least first substrate to be treated along its outer frame after receiving it; and wherein the distance between the first anode element of the at least first device element and the at least first substrate holder of the second device element ranges from 2 to 15 mm.

ii) Conducting a volume flow of treating solution through the through-going conduits of the first carrier element of the first device element and the subsequent through-going conduits of the first anode element of the first device element to the side of the at least first substrate to be treated received by the at least first substrate holder of the second device element which is directed to the anode surface of the first anode element of the first device element.

iii) Moving the second device element in two directions parallel to the treated side of the at least first substrate to be treated, wherein the two directions, into which the at least first substrate to be treated is moved, are orthogonal to each other and/or wherein the substrate is moved in an oscillating manner, preferably moved on a circular path parallel to the treated side of the at least first substrate to be treated.

It has been found advantageous in the present invention that the incoming flow of treating solution shall, if possible, reach the openings of the through-going conduits on the backside of the at least first carrier element all with the same, or at least with relatively similar, pressure to ensure a constant volume flow first through the through-going conduits of the at least first carrier element and second through the through-going conduits of the at least first anode element, both of the first and/or third device element, to reach the surface of the substrate to be treated of the second device element having the same, or at least relatively similar, volume flow and volume flow speed.

In a preferred embodiment of the method, the method is characterized in that in method step i) a further third device element is provided wherein the second device element is arranged between the first device element and the third device element and wherein said third device element comprises at least a first anode element having a plurality of through-going conduits and at least a first carrier element having a plurality of through-going conduits, wherein said at least first anode element and said at least first carrier element are firmly connected to each other; and wherein the distance between the first anode element of the at least third device element and the at least first substrate holder of the second device element ranges from 2 to 15 mm; and that in method step ii) a second volume flow of treating solution is conducted through the through-going conduits of the first carrier element of the third device element and the subsequent through-going conduits of the first anode element of the third device element to the side of the at least first substrate to be treated received by the at least first substrate holder of the second device element, which is directed to the anode surface of the first anode element of the third device element; and that in method step iii) the second device element is moved between the first device element and the third device element in two directions parallel to the treated side of the at least first substrate to be treated, wherein the two directions, into which the at least first substrate to be treated is moved, are orthogonal to each other and/or wherein the substrate is moved in an oscillating manner, preferably moved on a circular path parallel to the treated side of the at least first substrate to be treated.

A further advantage of said method is the possibility to regulate and/or to control the electrolyte volume flow speed, the current density and/or to select the electrolyte in order to promote either a bridge-building process to close interconnecting holes in the substrate to be treated (high current density e.g., 9 $A/cm^2$, and volume flow speed; first electrolyte) or a filling process of the blind holes for instance generated by such a bridge building process (lower current density, e.g., 5 $A/dm^2$, and volume flow speed; second electrolyte).

The present invention thus addresses the problem of providing a device for vertical galvanic metal, preferably copper, deposition on a substrate; and a method using such a device which successfully overcomes the above-mentioned shortcomings of the prior art.

The following non-limiting examples are provided to illustrate preferred embodiments of the present invention wherein the first anode element of the first device element is completely surrounded by the first carrier element of the first device element, wherein the side of said first carrier element directed towards said first anode element has a cavity to take said first anode element in such a way that the upper edges of the first carrier element and of the first anode element are aligned.

Turning now to the Figures, FIG. 1 shows a schematic front view of a first anode element 15 of a first or third device element of a preferred embodiment comprising a first anode segment 2 of the first anode element 15, a second anode segment 3 of the first anode element 15, and an intermediate spacing 4 between said first and second anode segment 2, 3 of the first anode element 15.

Further, FIG. 1 exhibit inside the first anode segment 2 four different fastening and electrical contact elements 5 of the first anode segment 2 of the first anode element 15, while inside the second anode segment 3 of the first anode element 15 four different fastening and electrical contact elements 6 are shown. Hereby, these four different fastening and electrical contact elements 6 are placed outside of the circular second anode segment 3 of the first anode element 15, which shall be not the case in a more preferable embodiment of the present invention due to several disadvantages, such as disturbance of the electrical field applied. However, the first anode element 15 shown in FIG. 1 has been successfully applied to fulfill the main purpose of the present invention.

Additionally, FIG. 1 shows a plurality of through-going conduits 7 of the first anode segment 2 of the first anode element 15, which are circularly arranged around the center of the first anode element 15. The through-going conduits comprise a cross section of an oblong hole, wherein the oblong holes have an orientation from the center to the outside of the first anode element. The center 8 of the first anode segment 2 of the first anode element 15 as well as the most exterior anode area 9, in this case equal to the second anode segment 3, of the first anode element 15 do not comprise any through-going conduits.

Figure 2:
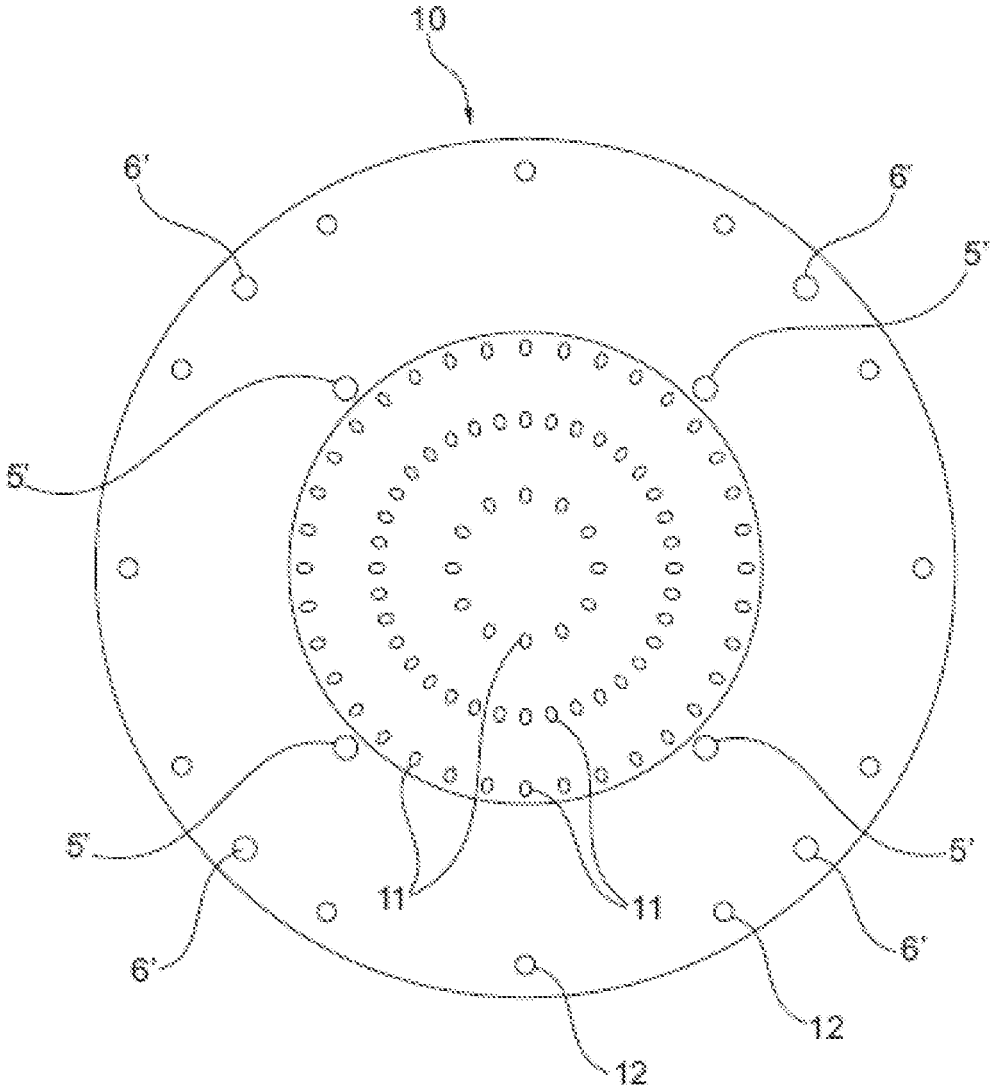
FIG. 2 shows a schematic back view of a first carrier element of the first device element of a preferred embodiment of the present invention.

FIG. 2 shows a schematic back view of a first carrier element 10 of the first device element of a preferred embodiment comprising through-going conduits 11, which are circularly arranged point symmetric around the center of the first carrier element 10, and fastening elements 12. Said through-going conduits comprise a circular cross section. Further, the fastening and electrical contact elements 5' of the first anode segment of the first anode element, which would be on the other side (the front side of the carrier element 10), are recognizable as well as the fastening and electrical contact elements of the second anode segment 6' of the first anode element. It is further worth to notify that the center of the backside of said first carrier element 10 has no through-going conduits leading naturally to the absence of through-going conduits in the center of the neighbored first anode element which is placed in the cavity of the first carrier element 10 on the front side (not shown in this Figure).

Figure 3:
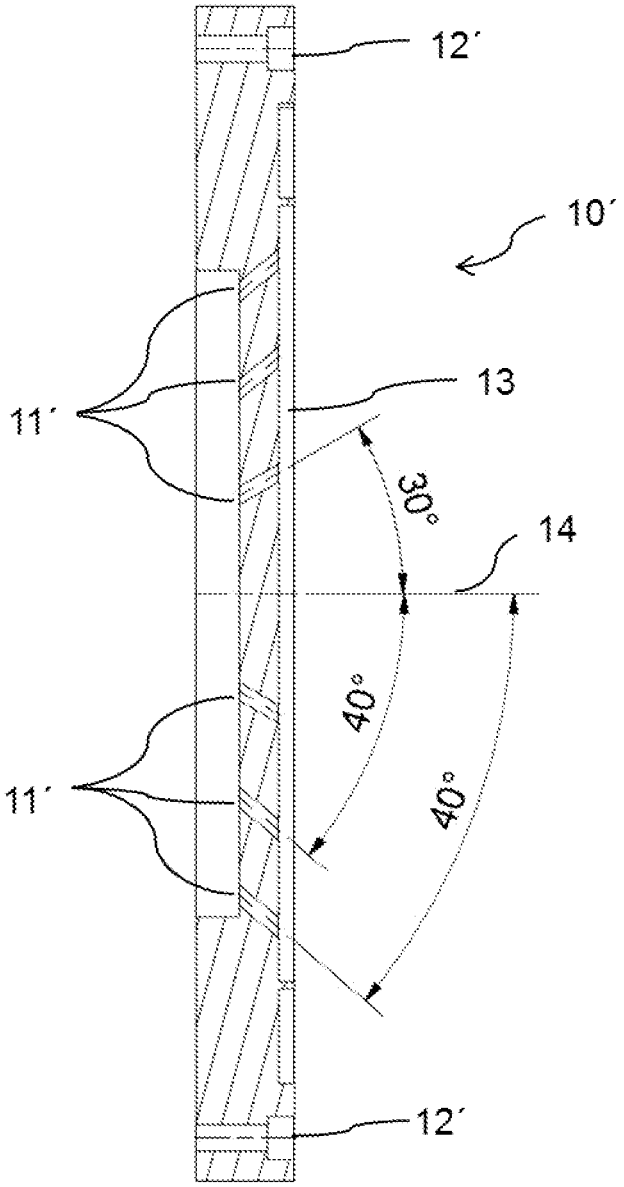
FIG. 3 shows a schematic view of one possible distribution of the through-going conduits of a first carrier element of the first device element of a preferred embodiment of the present invention.

FIG. 3 shows a schematic view of one possible distribution of the through-going conduits 11' of a first carrier element 10' of the first device element of a preferred embodiment comprising fastening elements 12' of the first carrier element 10' and a cavity 13 inside of the first carrier element 10' of the first or third device element, which is suitable to take the first anode element in such a way that the upper edges of the first carrier element 10' and of the first anode element are aligned. Further, FIG. 3 exhibit a perpendicular 14 on the first carrier element surface, which has been taken to measure the angles of the through-going conduits 11' of the first carrier element 10' relative to said perpendicular 14. It is clearly demonstrated that these through-going conduits 11' possess an angle of 30° in the closest position to the center of the carrier element 10' and 40° for the other, more exterior, through-going conduits 11'. But, it has to be noted that this illustrates a cut through the carrier element 10', which means that it is possible that each next through-going conduit 11' (not shown in FIG. 3), in particular in a circular arrangement around the center of the carrier element 10', could have the same or a different angle relative to the through-going conduits 11' shown in FIG. 3.

Figure 4:
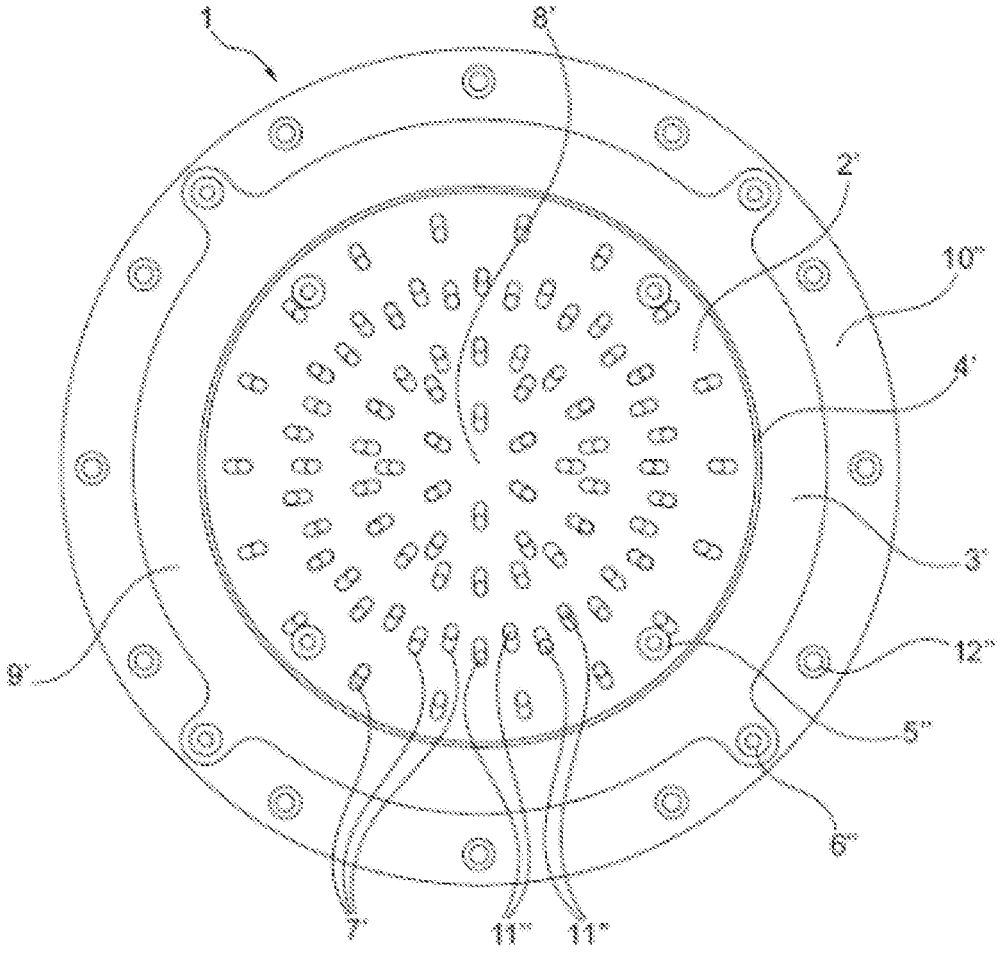
FIG. 4 shows a schematic front view of a first anode element in conjunction with a first carrier element, both of the first or third device element, of a preferred embodiment of the present invention.
Figure 5:
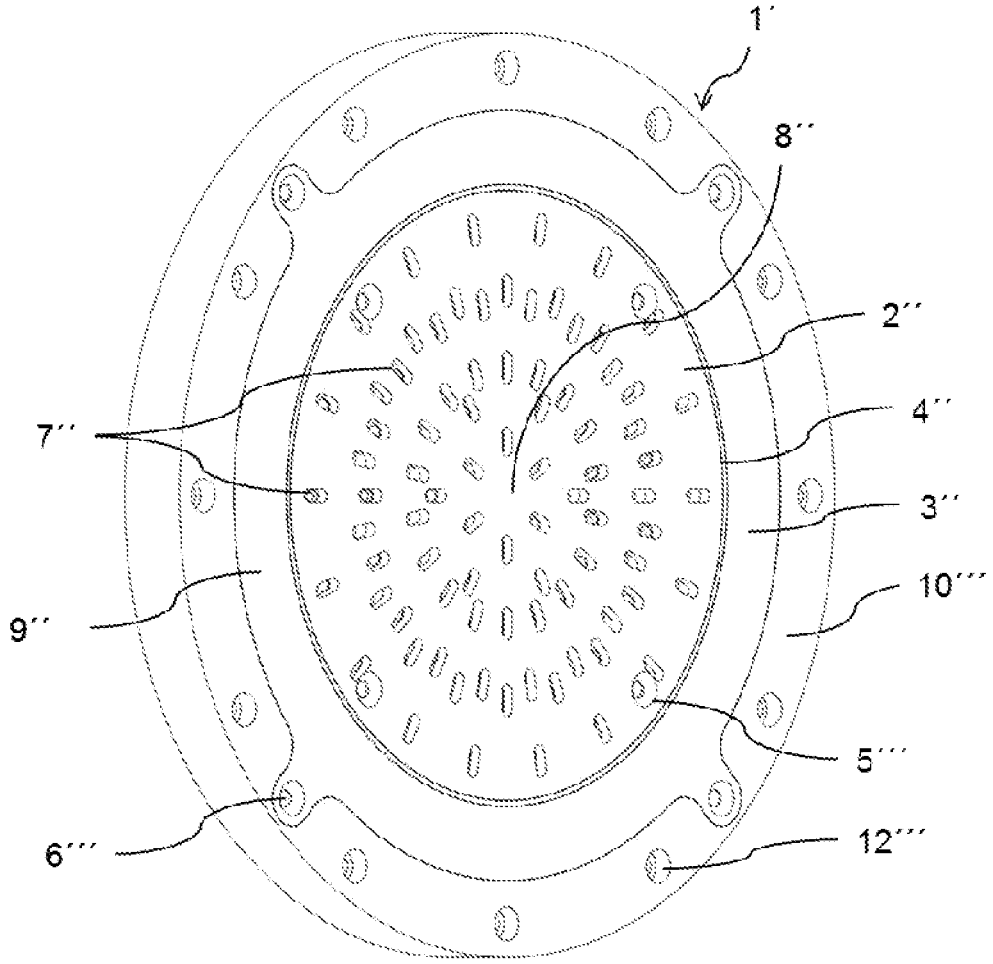
FIG. 5 shows a perspective front view of a first anode element in conjunction with a first carrier element, both of the first or third device element, of a preferred embodiment of the present invention.

FIGS. 4 and 5 show a front and a perspective view of a first anode element in conjunction with a first carrier element 10", 10'", both of the first or third device element 1, 1' of a preferred embodiment comprising a first anode segment 2', 2" and a second anode segment 3', 3" of the first anode element having an intermediate spacing 4', 4" between said first 2', 2" and second 3', 3" anode segment of the first anode element. Further, FIGS. 4 and 5 show fastening and electrical contact elements 5', 5'" of the first anode segment 2', 2" and fastening and electrical contact elements 6", 6'" of the second anode segment 3', 3" of the first anode element.

FIG. 4 shows also the through-going conduits 11" of the first carrier element 10", which are placed behind the first anode segment 2' and which can be seen in alternating order inside of the through-going conduits 7' of the first anode segment 2' of the first anode element. The expression "alternating order" means that each second through-going conduit 11" inside of a concentric circle around the center of the first carrier element 10" comprise the opposite angle of the respective precedent through-going conduit 11" relating to the perpendicular on the carrier element surface. FIG. 5 in contradiction thereto solely shows the through-going conduits 7" of the first anode segment 2" of the first anode element.

FIGS. 4 and 5 further show a center 8', 8" without through-going conduits 7', 7" in the first anode segment 2', 2" of the first anode element and a most exterior anode area 9', 9", which is in this case equal to the second anode segment 3', 3", of the first anode element without through-going conduits. Finally, there are fastening elements 12", 12'" of the first carrier element 10", 10'". In this embodiment of the invention, the most exterior circle of through-going conduits of the first anode segment 7', 7" serves the purpose to generate and/or to positively influence the incident volume flow of the treating solution in order to ensure that even the most exterior area of the first anode element, in this case the second anode segment 3', 3", will be properly and successfully conduct a galvanic metal, in particular copper, deposition, in particular to lead the incident volume flow of the treating solution up to the edges of the first anode element which are at least partially or, like in this preferred embodiment of the present invention, completely surrounded by the first carrier element 10", 10'".

Figure 6A:
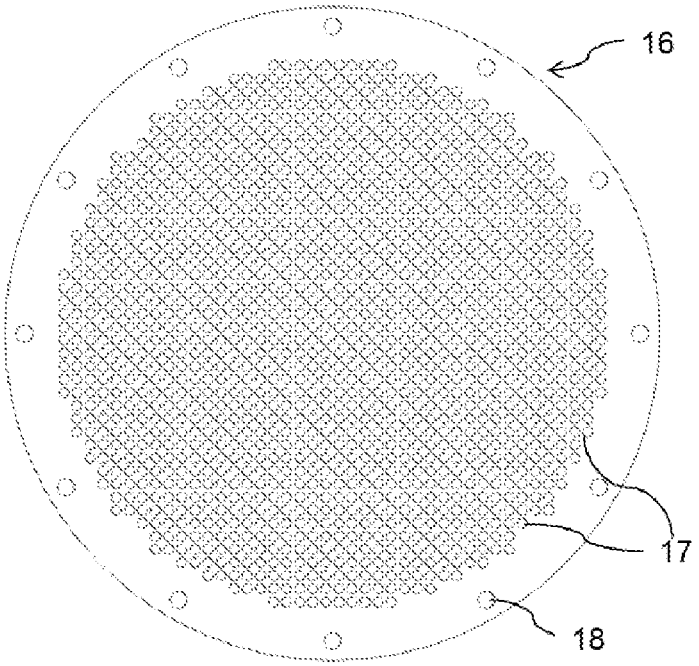
FIGS. 6*a* and 6*b* show a front view of a masking element having a homogeneous (FIG. 6*a*) or inhomogeneous (FIG. 6*b*) distribution of its through-going conduits of a preferred embodiment of the present invention.
Figure 6B:
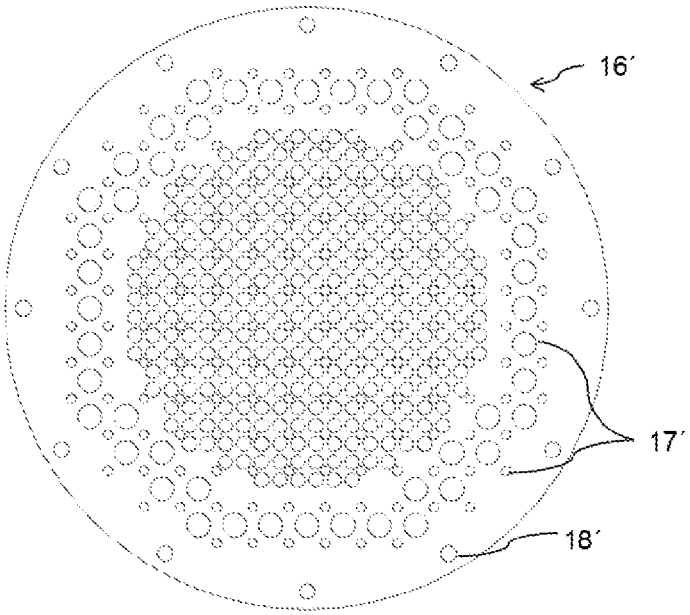

FIGS. 6*a* and 6*b* show a front view of a masking element 16, 16' having a homogeneous (FIG. 6*a*) or inhomogeneous (FIG. 6*b*) distribution of its through-going conduits 17, 17' of a preferred embodiment of the present invention. Further, FIGS. 6*a* and 6*b* disclose fastening elements 18, 18' of the masking element.

Figure 7A:
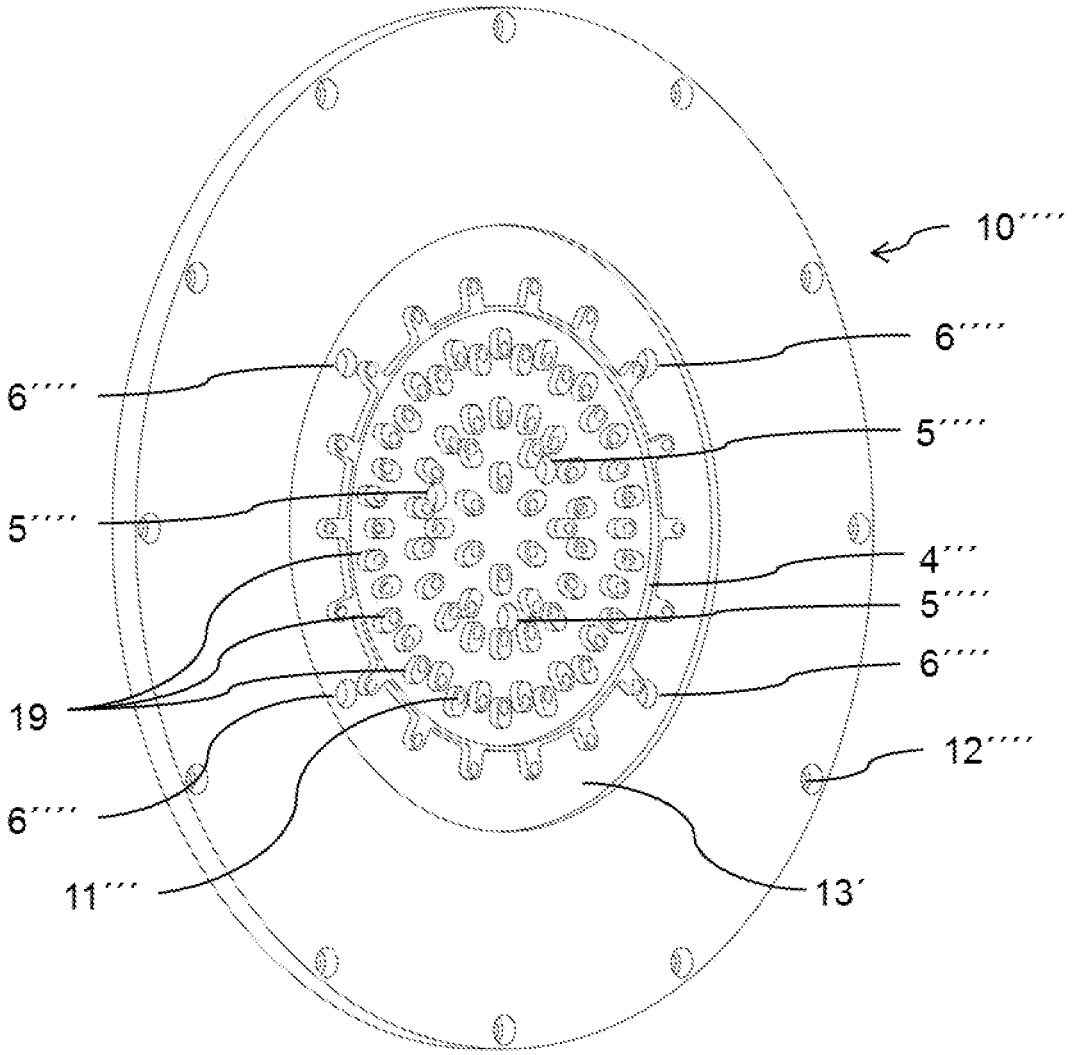
FIGS. 7*a*, 7*b* and 7*c* show a front view, a perspective view and an explosion view of a part of the perspective view of a first carrier element comprising a plurality of protrusions of a preferred embodiment of the present invention.
Figure 7B:
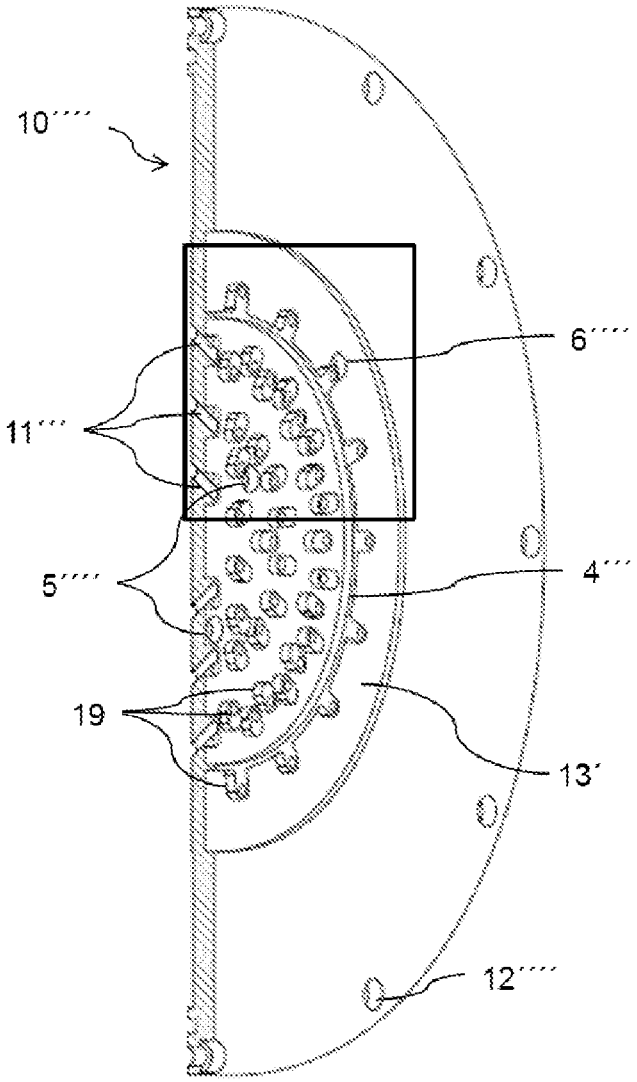
Figure 7C:
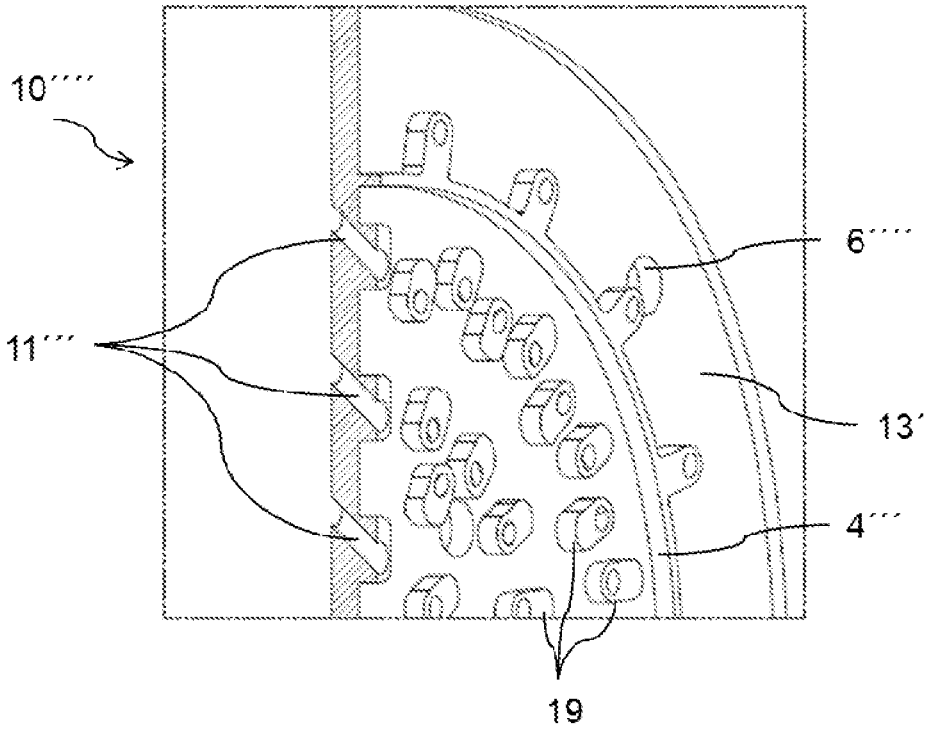

FIGS. 7*a* and 7*b* show a front and a perspective view of a first carrier element 10"" of the first or third device element of a preferred embodiment of the present invention comprising a plurality of protrusions 19. FIGS. 7*a* and 7*b* further show an intermediate spacing 4'" between first and second anode segment of the first anode element (anode segments are not shown in these Figures for a better illustration of the front surface of said preferred first carrier element). Furthermore, there are fastening elements and electrical contact elements 5"" for the first anode segment of the first anode element and fastening elements and electrical contact elements 6"" of the second anode segment of the first anode element. Hence, the first carrier element 10"" comprises a plurality of through-going conduits 11'", several fastening elements 12"" and a cavity 13'. FIG. 7*c* exhibits an explosion view of a part of the perspective view of FIG. 7*b* of a first carrier element 10"" of a preferred embodiment of the present invention comprising a plurality of protrusions 19.

It will be understood that the embodiments described herein are merely exemplary and that a person skilled in the art may make many variations and modifications without departing from the spirit and scope of the invention. All such variations and modifications, including those discussed above, are intended to be included within the scope of the invention as defined by the appended claims.

REFERENCE SIGNS

1, 1' First or third device element
2, 2', 2" First anode segment of the first anode element
3, 3', 3" Second anode segment of the first anode element
4, 4', 4", 4'" Intermediate spacing between first and second anode segment of the first anode element
5, 5', 5", 5'", 5"" Fastening element and electrical contact element of the first anode segment of the first anode element
6, 6', 6", 6'", 6"" Fastening element and electrical contact element of the second anode segment of the first anode element
7, 7', 7" Through-going conduits of the first anode segment of the first anode element
8, 8', 8" Center without through-going conduits in the first anode segment of the first anode element
9, 9', 9" Most exterior anode area of the first anode element of the first or third device element without through-going conduits
10, 10', 10", 10'", 10"" First carrier element of the first/ third device element
11, 11', 11", 11'" Through-going conduits of the first carrier element
12, 12', 12", 12'", 12"" Fastening elements of the first carrier element
13, 13' Cavity inside of the first carrier element
14 Perpendicular on the first carrier element surface
15 Anode element
16, 16' Masking element
17, 17' Through-going conduits of the masking element
18, 18' Fastening element of the masking element
19 Protrusions of the first carrier element

The invention claimed is:

1. Device for vertical galvanic metal deposition on a substrate wherein the device comprises at least a first device element and a second device element, which are arranged in a vertical manner parallel to each other, wherein the first device element comprises at least a first anode element having a plurality of through-going conduits and at least a first carrier element having a plurality of through-going conduits, wherein said at least first anode element and said at least first carrier element are firmly connected to each other; and wherein the second device element comprises at least a first substrate holder which is adapted to receive at least a first substrate to be treated, wherein said at least first substrate holder is at least partially surrounding the at least first substrate to be treated along its outer frame after receiving it; and wherein the distance between the first anode element of the at least first device element and the at least first substrate holder of the second device element ranges from 2 to 15 mm;

wherein the plurality of through-going conduits of the first carrier element of the first device element are going through the first carrier element in form of straight lines having an angle relating to the perpendicular on the carrier element surface between 10° and 60°.

2. Device according to claim 1 wherein the at least first substrate to be treated is round or angular, or a mixture of round and angular structure elements.

3. Device according to claim 1 wherein the device further comprises a third device element, which is arranged in a vertical manner parallel to the first device element and the second device element in such a way that the second device element is arranged between said first device element and said third device element, wherein the third device element comprises at least a first anode element having a plurality of through-going conduits and at least a first carrier element having a plurality of through-going conduits, wherein said at least first anode element and said at least first carrier element are firmly connected to each other; and wherein the distance between the first anode element of the at least third device element and the at least first substrate holder of the second device element ranges from 2 to 15 mm; wherein the plurality of through-going conduits of the first carrier element of the third device element are going through the first carrier element in form of straight lines having an angle relating to the perpendicular on the carrier element surface between 10° and 60°.

4. Device according to claim 3 wherein at least one of the first device element and the third device element further comprises a masking element having a plurality of through-going conduits, which is detachably connected to the at least first anode element of the at least one of the first device element and of the third device element, wherein the distribution of the plurality of through-going conduits on the surface of said masking element is homogenous or inhomogeneous.

5. Device according to claim 3 wherein the first carrier element of the at least one of the first device element and of the third device element further comprises a plurality of protrusions on the front surface directed to the at least first anode element, wherein said protrusions fit into the through-going conduits of the first anode element; and wherein the through-going conduits of the first carrier element are linearly extended through the whole protrusions.

6. Device according to claim 3 wherein the first anode element of the at least one of the first device element and of the third device element comprise at least two anode segments, wherein each anode segment can be electrically controlled separately from each other.

7. Device according to claim 3 wherein the plurality of through-going conduits of the first anode element of the at least one of the first device element and of the third device element are going through the first anode element in form of straight lines having an angle relative to the perpendicular on the first anode element surface between 0° and 80°.

8. Device according to claim 3 wherein the plurality of through-going conduits of the first anode element of the at least one of the first device element and of the third device element are arranged on the surface of the first anode element in form of concentric circles around the center of the first anode element.

9. Device according to claim 3 wherein the plurality of through-going conduits of the first carrier element of the at least one of the first device element and of the third device element which are going through the first carrier element in form of straight lines having an angle relating to the perpendicular on the carrier element surface between 10° and 60°;

wherein the angles of the through-going conduits of the first carrier element of the first device element being opposite to the through-going conduits of the first carrier element of the third device element are the same or different.

10. Device according to claim 3 wherein the first carrier element of the first device element and the first carrier element of the third device element, both comprising a plurality of through-going conduits which are going through the first carrier element in form of straight lines having an angle relating to the perpendicular on the carrier element surface between 10° and 60°; are arranged in a vertical manner parallel to each other in such a way that the plurality of through-going conduits of the first carrier element of the first device element are distributed in the same or different way as the plurality of through-going conduits of the first carrier element of the third device element.

11. Device according to claim 3 wherein the plurality of through-going conduits of at least one of the first carrier element of the first device element and of the first carrier element of the third device element are arranged on the surface of said first carrier element in form of concentric circles around the center of the first carrier element.

12. Device according to claim 3 wherein the first device element and the third device element are rotated against each other inside of the parallel plane of the vertical arrangement in order to set a specific orientation of the through-going conduits of the first carrier element of the first device element versus the through-going conduits of the first carrier element of the third device element.

13. Device according to claim 1 wherein the through-going conduits are arranged in at least first and second concentric circles around the center of the first carrier element, wherein the through-going conduits inside of the first concentric circle comprise different angles from the through-going conduits of the second concentric circle, wherein the angles are relative to a perpendicular line through the first carrier element.

14. Device according to claim 1 wherein the at least first substrate to be treated has a diameter ranging from 50 mm to 1000 mm, in case of a round structure; or a side length ranging from 10 mm to 1000 mm, in case of an angular structure.

15. Device according to claim 1 wherein the at least first substrate to be treated is a printed circuit board, a printed circuit foil, a semiconductor wafer, a solar cell, a photoelectric cell or a monitor cell.

16. Device according to claim 1 wherein a part of an anode segment or an entire anode segment does not comprise through-going conduits.

17. Device according to claim 16 wherein the part of the anode segment is the most exterior anode segment, the area around the center of the first anode element, or both the most exterior anode segment and the area around the center of the first anode element.

18. Device according to claim 1 wherein the through-going conduits are arranged in at least first and second concentric circles around the center of the first carrier element, wherein the through-going conduits inside of the first concentric circle arranged close around the center of the first carrier element comprise smaller angles than the through-going conduits inside of the second concentric circle being more exterior than the first concentric circle around the center of the first carrier element.

19. Method for vertical galvanic metal deposition on a substrate using a device according to claim 1 comprising the following method steps:

i) Providing the device according to claim 1;

ii) Conducting a volume flow of treating solution through the through-going conduits of the first carrier element of the first device element and the subsequent through-going conduits of the first anode element of the first device element to the side of the at least first substrate to be treated received by the at least first substrate holder of the second device element which is directed to the anode surface of the first anode element of the first device element; and iii) Moving the second device element in two directions parallel to the treated side of the at least first substrate to be treated.

20. Method according to claim 19 wherein in method step i) a further third device element is provided wherein the second device element is arranged between the first device element and the third device element and wherein said third device element comprises at least a first anode element having a plurality of through-going conduits and at least a first carrier element having a plurality of through-going conduits, wherein said at least first anode element and said at least first carrier element are firmly connected to each other; and wherein the distance between the first anode element of the at least third device element and the at least first substrate holder of the second device element ranges from 2 to 15 mm;

wherein in method step ii) a second volume flow of treating solution is conducted through the through-going conduits of the first carrier element of the third device element and the subsequent through-going conduits of the first anode element of the third device element to the side of the at least first substrate to be treated received by the at least first substrate holder of the second device element, which is directed to the anode surface of the first anode element of the third device element; and wherein in method step iii) the second device element is moved between the first device element and the third device element in two directions parallel to the treated side of the at least first substrate to be treated.

21. Device for vertical galvanic metal deposition on a substrate wherein the device comprises at least a first device element and a second device element, which are arranged in a vertical manner parallel to each other, wherein the first device element comprises at least a first anode element having a plurality of through-going conduits and at least a first carrier element having a plurality of through-going conduits, wherein said at least first anode element and said at least first carrier element are firmly connected to each other; and wherein the second device element comprises at least a first substrate holder which is adapted to receive at least a first substrate to be treated, wherein said at least first substrate holder is at least partially surrounding the at least first substrate to be treated along its outer frame after receiving it; and wherein the distance between the first anode element of the at least first device element and the at least first substrate holder of the second device element ranges from 2 to 15 mm;

wherein the plurality of through-going conduits of the first carrier element of the first device element are going through the first carrier element of the first device element in form of straight lines having an angle relating to the perpendicular on the carrier element surface between 10° and 60° and wherein the device further comprises a third device element, which is arranged in a vertical manner parallel to the first device element and the second device element in such a way that the second device element is arranged between said first device element and said third device element, wherein the third device element comprises at least a first anode element having a plurality of through-going conduits and at least a first carrier element having a plurality of through-going conduits, wherein said at least first anode element and said at least first carrier element are firmly connected to each other; and wherein the distance between the first anode element of the at least third device element and the at least first substrate holder of the second device element ranges from 2 to 15 mm;

wherein the plurality of through-going conduits of the first carrier element of the third device element are going through the first carrier element of the third device element in form of straight lines having an angle relating to the perpendicular on the carrier element surface between 10° and 60°.

* * * * *